US007522118B2

(12) United States Patent
Bu et al.

(10) Patent No.: US 7,522,118 B2
(45) Date of Patent: Apr. 21, 2009

(54) WIDEBAND I-SHAPED MONOPLE DIPOLE

(75) Inventors: Binlong Bu, Guangzhou (CN); Shanqiu Sun, Guangzhou (CN); Keyong Jiang, Guangzhou (CN); Chunhai Feng, Guangzhou (CN); Hongshan Chen, Guangzhou (CN)

(73) Assignee: Comba Telecom Technology (Guangzhou) Ltd., Guangzhou, P.R. (CN)

( * ) Notice: Subject to any disclaimer, the term of this patent is extended or adjusted under 35 U.S.C. 154(b) by 0 days.

(21) Appl. No.: 11/917,285

(22) PCT Filed: Dec. 22, 2005

(86) PCT No.: PCT/CN2005/002285

§ 371 (c)(1),
(2), (4) Date: Mar. 18, 2008

(87) PCT Pub. No.: WO2006/133610

PCT Pub. Date: Dec. 21, 2006

(65) Prior Publication Data

US 2008/0204345 A1 Aug. 28, 2008

(30) Foreign Application Priority Data

Jun. 13, 2005 (CN) ..... 2005 2 0059646 U

(51) Int. Cl.
*H01Q 21/12* (2006.01)
*H01Q 21/00* (2006.01)

(52) U.S. Cl. ..... 343/812; 343/810

(58) Field of Classification Search ..... 343/793, 343/797, 810–820, 846, 795, 853
See application file for complete search history.

(56) References Cited

U.S. PATENT DOCUMENTS

| | | | | | |
|---|---|---|---|---|---|
| 5,274,391 | A * | 12/1993 | Connolly | ..... | 343/820 |
| 5,936,590 | A * | 8/1999 | Funder | ..... | 343/795 |
| 6,034,649 | A * | 3/2000 | Wilson et al. | ..... | 343/795 |
| 7,209,091 | B2 * | 4/2007 | Schadler et al. | ..... | 343/812 |

FOREIGN PATENT DOCUMENTS

| | | |
|---|---|---|
| CN | 2561111 Y | 7/2003 |
| GB | 2 171 257 | 8/1986 |
| WO | WO 97/45892 | 12/1997 |

OTHER PUBLICATIONS

International Search Report for International Application No. PCT/CN2005/002285 completed Mar. 13, 2006.

* cited by examiner

*Primary Examiner*—Shih-Chao Chen
(74) *Attorney, Agent, or Firm*—Alston & Bird LLP

(57) ABSTRACT

A wideband I--shaped monopole dipole includes a first dipole unit, a second dipole unit, a feed device, a parallel-wire and two double-leads set between two cantilevers of the first dipole unit and the second dipole unit. The parallel-wire connects the first dipole unit with the second dipole unit in a parallel connection. The feed device includes a feed pad and a coaxial cable. The double-leads between the cantilevers of the first and second dipole units extend to form two parallel plates acting as a first balancer and a second balancer to balance impedance components of the first and second dipole units. A feed point of the feed device is disposed on a center portion of the parallel-wire. The feed pad is provided on one line of the parallel-wire. Outer and inner conductors of the coaxial cable are respectively coupled to the feed pad and the other line of the parallel-wire.

5 Claims, 5 Drawing Sheets

Out-of-round: ±21.10dB
LOG: 6dB/div
Measuring Frequency: 1710MHz
Measuring Time: 2004—6—30
Measuring Range: 360°
F/B: 31.21dB
Most Level: -34.928dBm XdBW(-3.0dB):65.25°
POL: Vertical (H-plane direction pattern)

Out-of-round: ±22.36dB
LOG: 6dB/div
Measuring Frequency: 1920MH
Measuring Time: 2004—6—30

Measuring Range: 360°
F/B: 31.50dB
Most Level: -35.3dBm XdBW(-3.0dB):62.42°
POL: Vertical (H-plane direction pattern)

Out-of round: ±22.07dB
LOG: 6dB/div
Measuring Frequency: 2170MHz
Measuring Time: 2004—6—30

Measuring Range: 360°
F/B: 31.35dB
Most Level: -38.843dBm XdBW(-3.0dB):59.63°
POL: Vertical (H-plane direction pattern)

WIDEBAND I-SHAPED MONOPLE DIPOLE

BACKGROUND OF THE INVENTION

1. Field of the Invention

The present invention generally relates to dipoles and, more particularly, to a wideband I-shaped monopole dipole.

2. Description of Related Art

For base station systems in mobile communication, wideband antennas which have high front-back ratio and medium beamwidth are generally needed, for instance wideband antennas having beamwidth of 90°, 65° or 32°, or wideband antennas used in a dual-band common use of CDMA and GSM, DCS and PCS, or PCS and UMTS, or wideband antennas used in a tri-band common use of DCS, PCS and UMTS. Known wideband antennas which can meet requirements of the above radiation characteristics are corner reflector antennas and logarithm periodic antennas. However, corner reflector antennas and logarithm periodic antennas usually have large size and high manufacturing cost.

To overcome the shortcomings as previously described, persons in the field of mobile communication analyzed and found that:

A half-wave symmetrical dipole having a beamwidth of about 75~80° in an H-plane is set above a boundless metallic-based reflective plate and has a quarter-wave distance to the boundless metallic-based reflective plate. When the height of the dipole is adjusted, the beamwidth will also change accordingly. However, the change range of the beamwidth is narrow and the beamwidth of 90±8° or 65±6° is unlikely to be obtained. If the reflective plate is limited in a range of less than four-fifth wave, the front-back ratio of the dipole is unlikely to be controlled below the range of 28 dB to 30 dB.

To obtain a predetermined beamwidth in the H-plane and a high front-back ratio, based on suggestions of double-ring antennas, a I-shaped monopole dipole is formed by a connection of two symmetrical dipoles in a same plane by a parallel-wire, and a balance feed on a center portion of the parallel-wire. Via adjusting the size of the symmetrical dipoles and the impedance of the parallel-wire, an impedance match on feed points can be performed.

As shown in FIG. 1, the improved I-shaped monopole dipole has a simpler configuration and fewer feed points and, thus, control of the beamwidth in the H-plane and the front-back ratio is able to be realized, which can overcome shortcomings of the corner reflector antennas and the logarithm periodic antennas. However, in practice, since the bandwidth with the standing wave ratio thereof less than 1.30 is about 10%, the I-shaped monopole dipole can only meet the requirements of a single-band of CDMA, GSM, DCS or UMTS, but cannot meet the requirements of a dual-band common use of CDMA and GSM824~960 MHz, a tri-band common use of DCS1710~1880 MHz, PCS1850~1990 MHz and UMTS1920~2170 MHz, or a dual-band common use of two of DCS1710~1880 MHz, PCS1850~1990 MHz and UMTS1920~2170 MHz.

In summary, employing the wideband I-shaped monopole dipoles as radiation units is simple and reliable, and has a lower cost manufacturing. However, if the metallic-based reflective plate is limited, the front-back ratio is hard to control. Also, the ordinary conventional half-wave dipoles cannot perform a wideband capability. When a number of radiation rows are utilized to control the front-back ratio, a complex feed network is needed, which will inevitably increase the manufacturing cost.

SUMMARY OF THE INVENTION

An object of the present invention is to overcome the shortcomings as set forth above and provide a wideband I-shaped monopole dipole which can perform a wideband capability and a radiation characteristic of high front-back ratio, and has a relative lower manufacturing cost.

To fulfill the above object, a wideband I-shaped monopole dipole is provided. The wideband I-shaped monopole dipole includes a first dipole unit, a second dipole unit, a feed device, a parallel-wire and double-leads formed between cantilevers of the first and second dipole units. The parallel-wire connects the first dipole unit with the second dipole unit in a parallel connection. The feed device includes a feed pad and an additional coaxial cable. Each of the double-leads between the cantilevers of the first and second dipole units extends to form two parallel plates functioning as a first balancer and a second balancer which can be used to balance impedance components of the first and second dipole units. A feed point of the feed device is disposed on a center portion of the parallel-wire. The feed pad is arranged on one line of the parallel-wire, and outer and inner conductors of the coaxial cable respectively connect with the feed pad and the other line of the parallel-wire.

Compared with the prior designs, the wideband I-shaped monopole dipole according to the present invention has at least the following advantages: a wideband capability and a radiation characteristic with a high front-back ratio can be performed without observably changing the size of the metallic-based reflective plate, and improved configuration of the wideband I-shaped monopole dipole is simple, thereby facilitating assembling and maintaining and reducing the manufacturing cost thereof.

Other advantages and novel features will be drawn from the following detailed description of preferred embodiment with the attached drawings, in which:

DETAILED DESCRIPTION OF THE INVENTION

Figure 1:
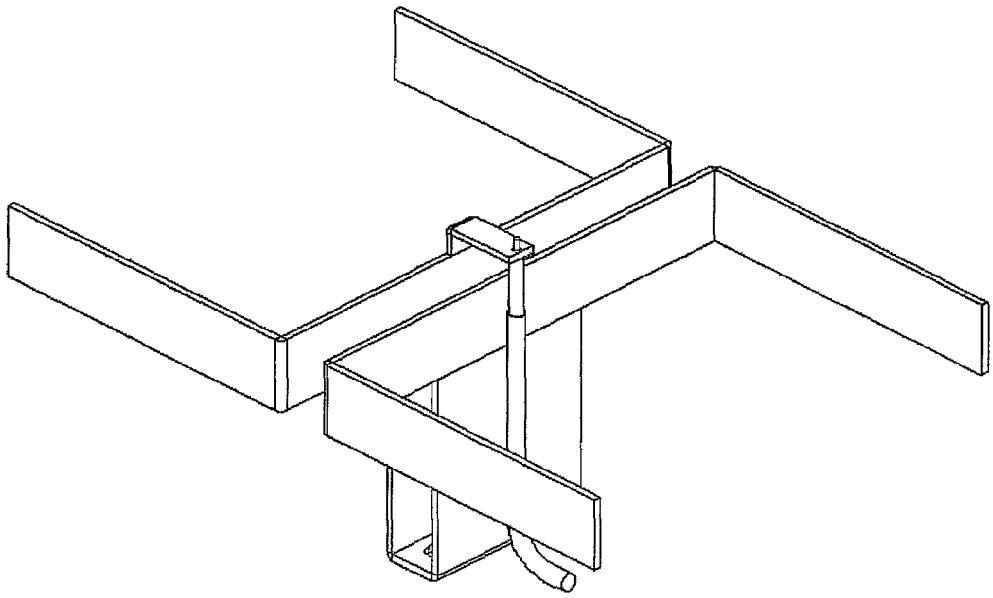
(PRIOR ART) FIG. 1
FIG. 1 is a perspective view of a conventional I-shaped dipole.
Figure 2:
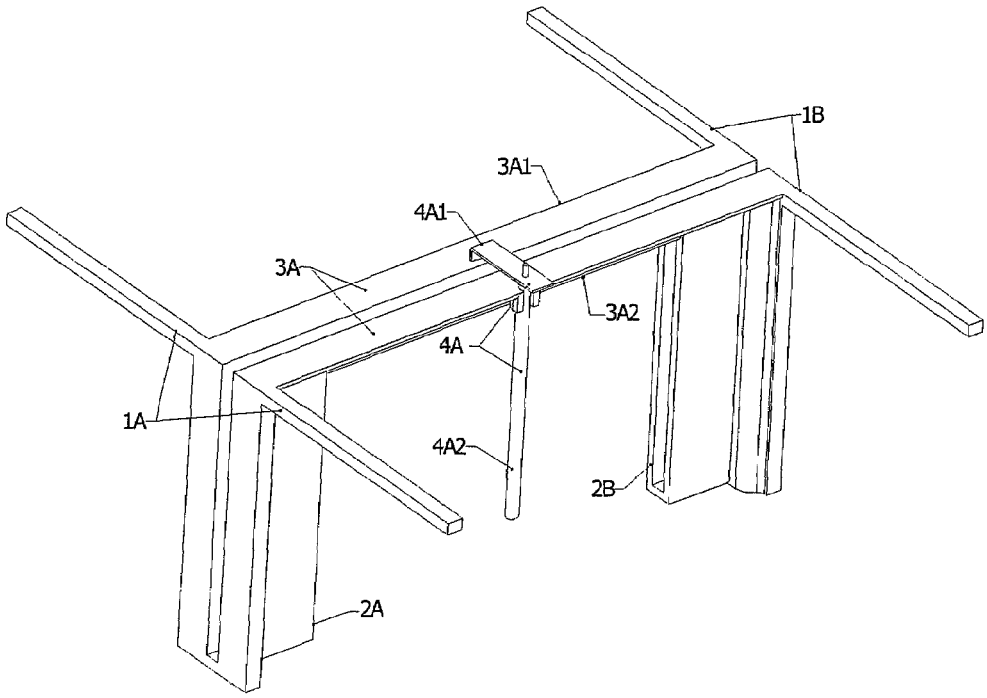
FIG. 2 is a perspective view of a wideband I-shaped monopole dipole in accordance with a preferred embodiment of the present invention.

Referring to FIG. 2, a wideband I-shaped monopole dipole according to a preferred embodiment of the present invention includes a first dipole unit 1A, a second dipole unit 1B, a first balancer 2A, a second balancer 2B, a parallel-wire 3A including two parallel lines 3A1, 3A2, and a feed device 4A having a feed pad 4A1 and a coaxial cable 4A2. Each of the first and second balancers 2A, 2B is formed by two parallel plates extending downwardly from a double-lead between two cantilevers of corresponding dipole unit 1A, 1B. The feed pad 4A1 is disposed on one line 3A1 of the parallel-wire 3A. The first balancer 2A balances a part of the impedance component of the first dipole unit 1A, and the second balancer 2A balances a part of the impedance component of the second dipole unit 2A. Then, the first and second dipole units 1A, 1B, that have been counteracted the part impedance components, are connected to each other in a parallel connection by the parallel-wire 3A. In center portion of the parallel-wire 3A, the coaxial cable 4A2 is arranged with inner and outer conductors thereof connecting with the feed pad 4A1 and the other line 3A2 of the parallel-wire 3A, respectively, and, therefore, a feed point is provided on the other line 3A2 to connect the parallel-wire 3A with the feed device 4A. Through adjusting the feed pad 4A1 and the impedance of the parallel-wire 3A, a wideband capability can be achieved.

Figure 3:
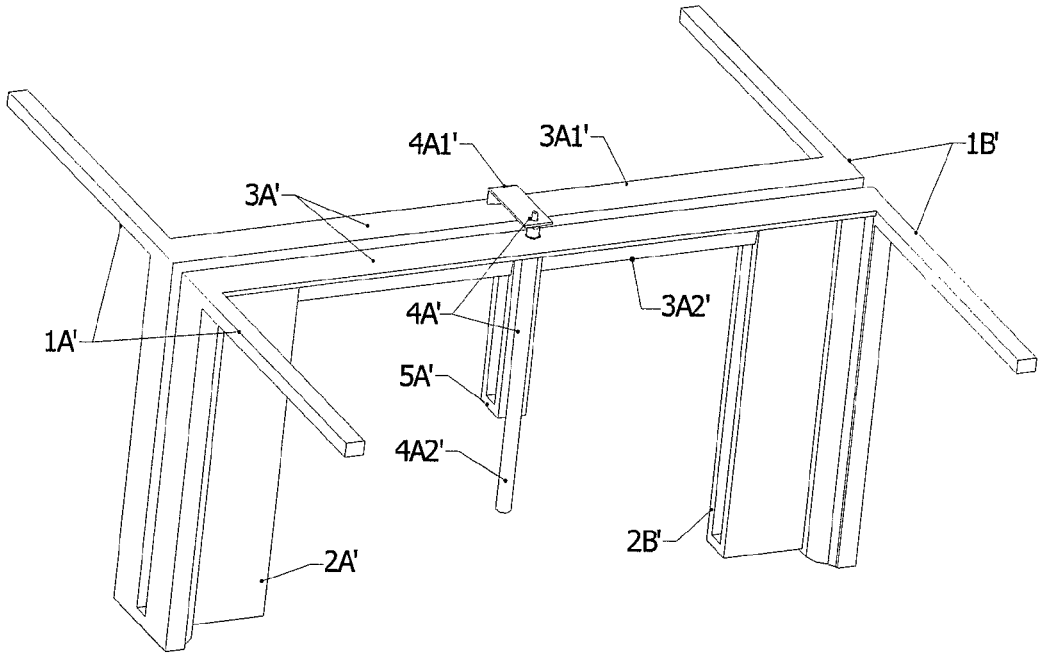
FIG. 3 is a perspective view of a wideband I-shaped monopole dipole in accordance with an alternative embodiment of the present invention.

Referring to FIG. 3, a wideband ⊥-shaped monopole dipole according to an alternative embodiment of the present invention is shown. The difference between the first embodiment and the alternative embodiment is: the wideband ⊥-shaped monopole dipole of the alternative embodiment further includes a third balancer 5A'. The third balancer 5A" extends downwardly from the center feed portion of the parallel-wire 3A'. The inner and outer conductors of the coaxial cable 4A2' respectively connect with the feed pad 4A1' and the third balancer 5A', and are fed, in order to achieve a wideband capability. Alternatively, the inner and outer conductors of the coaxial cable 4A2' can be connected with two plates 5A1', 5A2' of the third balancer 5A', respectively, and are fed, in order to achieve a wideband capability.

Figure 4:
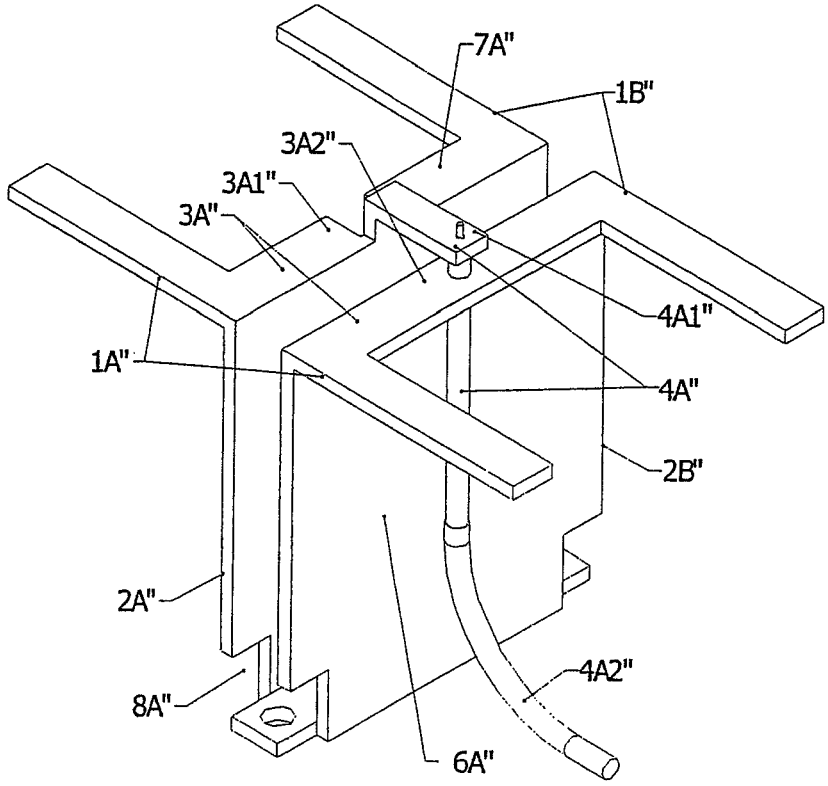
FIG. 4 is a perspective view of a wideband I-shaped monopole dipole in accordance with a third embodiment of the present invention.

Referring to FIG. 4, a wideband ⊥-shaped monopole dipole according to a third embodiment of the present invention is illustrated. The difference between the first embodiment and the third embodiment is: the wideband ⊥-shaped monopole dipole of the third embodiment includes a wideband balancer 6A". The wideband balancer 6A" is formed by an integrative configuration of the first balancer 2A", the second balancer 2B" and the parallel-wire 3A" as described in the first embodiment. A feed pad 4A" is set on a plate 3A1" of the wideband balancer 6A". Inner and outer conductor of a coaxial cable respectively connect with the feed pad 4A1" and a center portion of the other plate 3A2" of the wideband balancer 6A", thereby achieving a wideband capability. To facilitate welding in assembly, a supporting element 7A" is provided on an upper portion of the wideband balancer 6A" and a recess 8A" is defined in a lower portion of the wideband balancer 6A".

Figure 5:
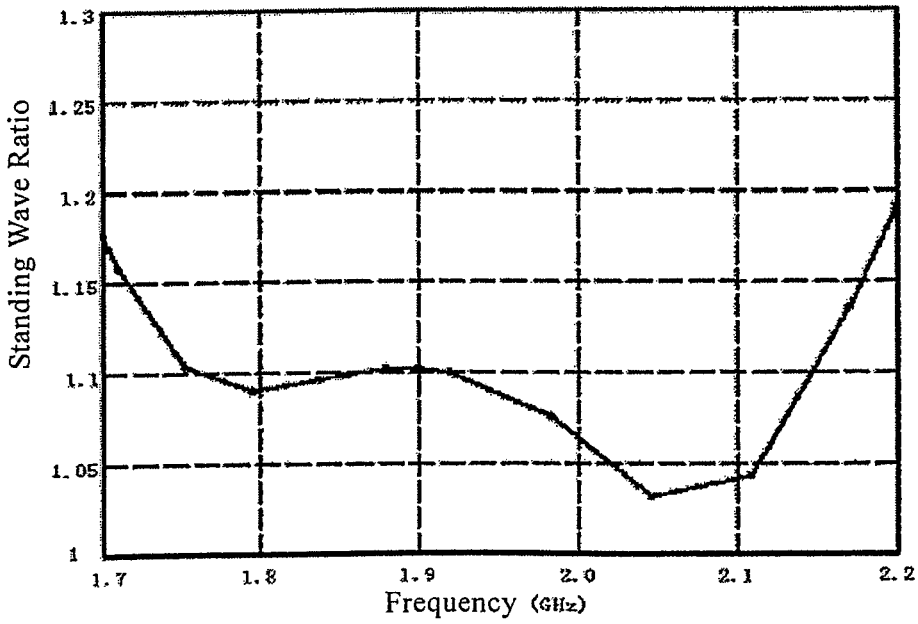
FIG. 5 is a matching characteristic diagram of the wideband I-shaped monopole dipole in FIG. 4 with a frequency of 1.7 GHz to 2.2 GHz.

Referring to FIG. 5, a matching characteristic diagram of the wideband ⊥-shaped monopole dipole of the third embodiment that works with a frequency ranged from 1.7 GHz to 2.2 GHz is illustrated. From FIG. 5, it is known that the performance of the wideband ⊥-shaped monopole dipole is remarkably improved.

Figure 6:
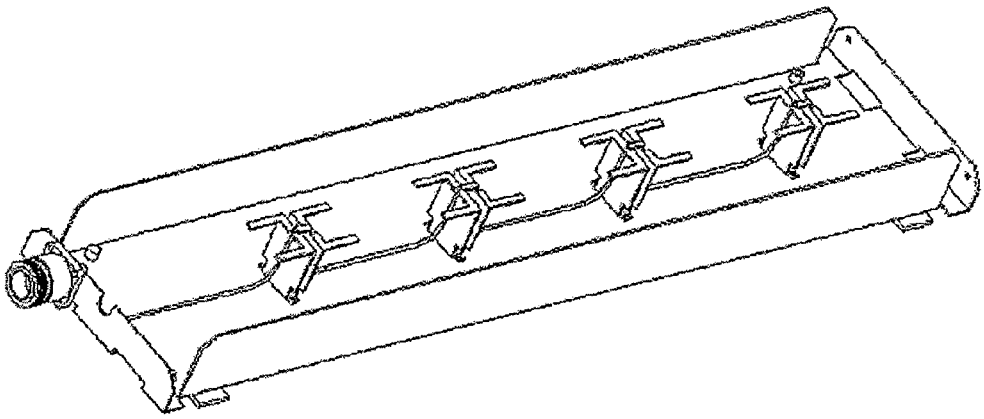
FIG. 6 is a perspective view of a 1.7~2.2 GHz monopole antenna with a beamwidth of 65°, which employs the wideband I-shaped monopole dipoles in FIG. 4.
Figure 7:
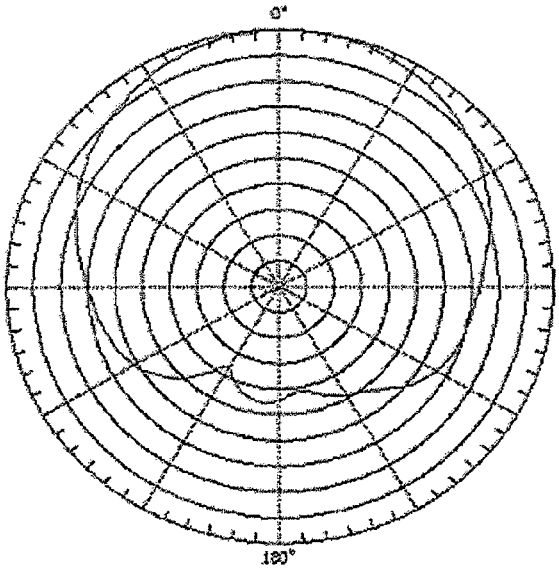
FIGS. 7, 8 and 9 are radiation characteristic diagrams of the antenna shown in FIG. 6, respectively.
Figure 8:
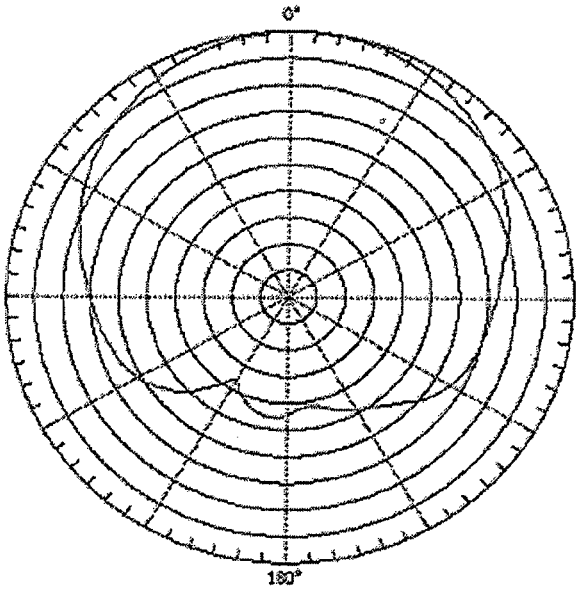
Figure 9:
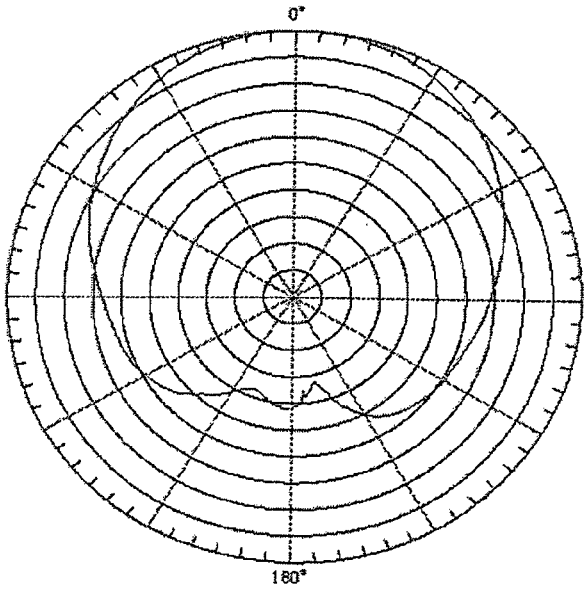

Referring to FIG. 6, a 1.7 GHz to 2.2 GHz monopole antenna with a beamwidth of 65° that employs a number of the wideband ⊥-shaped monopole dipoles in accordance with the present invention is shown. To form this antenna, the wideband ⊥-shaped monopole dipoles are aligned on the metallic-based reflective plate at equal intervals and are fed via the coaxial cable. The relevant radiation characteristic diagrams of the above antenna are shown in FIGS. 7 to 9.

Since the arrangement of the balance feed is well known for one ordinary in the art of the present invention, the coaxial cable in accordance with the embodiments of the present invention can also be exchanged with other equivalent configurations (e.g., a parallel-wire, etc.) and, thus, the applications employing other configurations equivalent to the coaxial cable are not described in detailed.

The bandwidth of a monopole antenna with a horizontal beamwidth of 90°, 65°, or 32°, which employs the wideband ⊥-shaped monopole dipoles of the present invention as radiation units is above 25%. In a dual-band common use of CDMA824~896 MHz and GSM870~960 MHz, a tri-band common use of DCS1710~1880 MHz, PCS1850~1990 MHz and UMTS1920~2170 MHz, or a dual-band common use of two of DCS1710~1880 MHz, PCS1850~1990 MHz and UMTS1920~2170 MHz, the typical electric characteristics of the monopole antennas are shown as followed:

The standing wave ratio is less than 1.25.

When the horizontal beamwidth is 90°±8°, the front-back ratio is better than 28 dB.

When the horizontal beamwidth is 65°±6°, the front-back ratio is better than 30 dB.

When the horizontal beamwidth is 32±4°, the front-back ratio is better than 33 dB.

When the monopole antenna is used in single-band, dispersion of beamwidth is relatively less and reaches 90°±5°, 65°±4° and 32°±3°, respectively.

in view of the above description, it is known that the wideband ⊥-shaped monopole dipoles according to the present invention can perform a wideband capability and a radiation characteristic of a high front-back ratio even without changing size of the metallic-based reflective. Additionally, the improved configuration of the wideband ⊥-shaped monopole dipoles is simple and, thus, can facilitate formation of the metal sheet, save materials and reduce the manufacturing cost and, particularly, facilitate assembling and maintaining.

What is claimed is:

1. A wideband ⊥-shaped monopole dipole comprising a first dipole unit, a second dipole unit, a feed device, a parallel-wire and double-leads formed between cantilevers of said first and second dipole units, said parallel-wire connecting said first dipole unit with said second dipole unit in a parallel connection, said feed device comprising a feed pad and a coaxial cable, wherein said double-leads between said cantilevers of said first and second dipole units extend to form parallel plates acting as a first balancer and a second balancer to balance impedance components of said first and second dipole units, said feed device is disposed on a center portion of the parallel-wire, the feed pad is arranged on one line of the parallel-wire, and outer and inner conductors of said coaxial cable connect with said feed pad and the other line of said parallel-wire, respectively.

2. The wideband ⊥-shaped monopole dipole of claim 1, wherein said double-leads between said cantilevers of said first and second dipole units and said parallel-wire are designed in an integrative configuration and extend downwardly to form a wideband balancer.

3. The wideband ⊥-shaped monopole dipole of claim 2, wherein a supporting element is disposed on an upper portion of said balancer and a recess is defined in an lower portion of said balancer.

4. A wideband ⊥-shaped monopole dipole comprising a first dipole unit, a second dipole unit, a feed device, a parallel-wire and double-leads formed between cantilevers of said first and second dipole units, said double-leads connecting said first dipole unit with said second dipole unit in a parallel connection, said feed device comprising a feed pad and a coaxial cable, wherein said double-leads between said cantilevers of said first and second dipole units extend to form parallel plates in order to respectively provide a first balancer and a second balancer to balance impedance components of said first and second dipole units, a third balancer is disposed on a center portion of said parallel-wire, said feed pad is arranged on one line of said parallel-wire, and outer and inner conductors of said coaxial cable respectively connect with said feed pad and said third balancer, thereby obtaining a balancer feed.

5. A wideband I--shaped monopole dipole comprising a first dipole unit, a second dipole unit, a feed device, a parallel-wire, and double-leads formed between cantilevers of said first and second dipole units, the double-leads connecting said first dipole unit with said second dipole unit in a parallel connection, said feed device comprising a coaxial cable, wherein the double-leads extend to form parallel plates to respectively provide a first balancer and a second balancer to balance impedance components of said first and second dipole units, a third balancer is disposed on a center portion of said parallel-wire, said third balancer comprises two plates, and outer and inner conductors of said coaxial cable are connected with said plates of said third balancer, respectively, so as to achieve a balancer feed.

* * * * *